US006792905B2

(12) United States Patent
Ghelfi et al.

(10) Patent No.: US 6,792,905 B2
(45) Date of Patent: Sep. 21, 2004

(54) COMPRESSION RELEASE MECHANISM

(75) Inventors: Giuseppe Ghelfi, Turin (IT); Maurizio Borio, Turin (IT); Stefano Albanello, Chatillon (IT); Giovanni Arisio, Turin (IT)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 10/351,202

(22) Filed: Jan. 24, 2003

(65) Prior Publication Data

US 2004/0144352 A1 Jul. 29, 2004

(51) Int. Cl.[7] ..... F01L 13/08
(52) U.S. Cl. ..... 123/182.1
(58) Field of Search ..... 123/182.1

(56) References Cited

U.S. PATENT DOCUMENTS

| | | | | |
|---|---|---|---|---|
| 754,466 A | | 3/1904 | Lewis | 123/182.1 |
| 862,448 A | | 8/1907 | Cornilleau | 123/90.17 |
| 4,696,266 A | * | 9/1987 | Harada | 123/182.1 |
| 5,184,586 A | | 2/1993 | Buchholz | 123/182.1 |
| 5,957,097 A | | 9/1999 | Schanz | 123/90.17 |
| 6,109,230 A | * | 8/2000 | Watanabe et al. | 123/182.1 |

FOREIGN PATENT DOCUMENTS

| | | |
|---|---|---|
| DE | 42 21 394 | 1/1994 |

* cited by examiner

*Primary Examiner*—Andrew M. Dolinar
(74) *Attorney, Agent, or Firm*—Baker & Daniels

(57) ABSTRACT

A compression release mechanism for small internal combustion engines, including a compression release member having an auxiliary cam and a weight section. The compression release member is supported for rotation on an annular bearing surface which is in eccentric relation to the longitudinal axis of the engine camshaft. At engine cranking speeds, the compression release member rotates with the camshaft, and the auxiliary cam projects beyond the base circle of a cam lobe on the camshaft to periodically engage a valve to vent pressure from the engine combustion chamber during the compression stroke of the piston to aid in engine cranking. After the engine starts, rapid rotation of the camshaft causes the compression release member to rotate under the inertial load of the weight section thereof to a position in which the auxiliary cam is retracted within the base circle of the cam lobe such that combustion may proceed in a conventional manner.

19 Claims, 4 Drawing Sheets

COMPRESSION RELEASE MECHANISM

BACKGROUND OF THE INVENTION

1. Field of the Invention

The present invention relates to compression release mechanisms for small internal combustion engines of the type used in a variety of applications, such as lawnmowers, generators, pumps, tillers, pressure washers and other lawn and garden implements, or in small utility vehicles such as riding lawnmowers, lawn tractors, and the like.

2. Description of the Related Art

Generally, the intake and exhaust valves of small internal combustion engines may be actuated directly by a camshaft located in the cylinder head, or may be actuated indirectly through the use of rocker arms, tappets, or other similar means. For example, in many existing L-head and overhead valve ("OHV") engines, the crankshaft drives a camshaft which is located within the crankcase and is disposed parallel to the crankshaft, and lobes on the camshaft actuate lifters, push rods and/or rocker arms to open and close the valves. In overhead cam ("OHC"), engines, a camshaft located in the cylinder head of the engine is driven from the crankshaft, and includes lobes thereon which directly actuate intake and exhaust valves. One such overhead cam engine is disclosed in U.S. Pat. No. 6,295,959, assigned to the assignee of the present invention, the disclosure of which is expressly incorporated herein by reference.

At engine cranking speeds during engine starting, the intake and exhaust valves are both closed as the piston rises toward its top dead center position, and substantial pressure is built up in the combustion chamber which resists movement of the piston toward the top dead center position. This pressure must be overcome to crank the engine for starting, and typically requires a substantial amount of force to be exerted by the operator, such as by pulling on the rope of a recoil starter. Therefore, small internal combustion engines typically include a type of compression release mechanism to aid in engine starting.

Compression release mechanisms for small internal combustion engines are usually operable at cranking speeds to prevent the exhaust valve from fully closing as the piston reaches its top dead center position, thereby allowing venting of pressure from the combustion chamber. In this manner, cranking of the engine is much easier and requires less force to be exerted by the operator. When the engine reaches a predetermined speed after starting, the compression release mechanism is automatically rendered inoperative, such that the exhaust valve fully seats or closes as the piston approaches its top dead center position to allow combustion to proceed in a conventional manner.

A problem with many known compression release mechanisms is that such devices include a large number of individual parts, and are often mechanically complex. Further, such devices typically take up an undesirably large amount of space around the camshaft of the engine.

What is needed is a compression release mechanism for small internal combustion engines which includes a relatively few number of parts, is durable, and which is compact in construction.

SUMMARY OF THE INVENTION

The present invention provides a compression release mechanism for small internal combustion engines, including a compression release member having an auxiliary cam and a weight section. The compression release member is supported for rotation on an annular bearing surface which is in eccentric relation to the longitudinal axis of the engine camshaft. At engine cranking speeds, the compression release member rotates with the camshaft, and the auxiliary cam projects beyond the base circle of a cam lobe on the camshaft to periodically engage a valve to vent pressure from the engine combustion chamber during the compression stroke of the piston to aid in cranking the engine during starting. After the engine starts, rapid rotation of the camshaft causes the compression release member to rotate under the inertial load of the weight section thereof to a position in which the auxiliary cam is retracted within the base circle of the cam lobe such that combustion may proceed in a conventional manner.

More specifically, in one embodiment, the compression release mechanism includes a first collar which is rotationally fixed with respect to the camshaft, the first collar having a hub portion eccentric with respect to the camshaft. A second collar includes an auxiliary cam and a weight section, and is supported for rotation on the hub portion of the first collar between first and second positions. In the first position, which corresponds to engine cranking speeds, a spring connected between the first and second collars biases the second collar to a rotational position in which the auxiliary cam projects beyond the base circle of the cam lobe to engage and at least partially open the valve. In this manner, a portion of the pressure within the combustion chamber is vented during the compression stroke of the piston to aid in engine cranking. After the engine is started and the rotational speed of the camshaft rapidly increases, the inertial load of the weight section of the second collar overcomes the bias force of the spring, and the second collar rotates to a rotational position in which the auxiliary cam is positioned within the base circle of the cam lobe such that the auxiliary cam does not engage the valve, allowing combustion to proceed in a conventional manner.

Advantageously, the construction of the compression release mechanism, which includes the first collar positioned on a crankshaft adjacent the cam lobe, and the second collar supported for rotation upon the first collar, it is very compact in construction, such that the compression release mechanism takes up a minimal amount of space around the camshaft.

The second collar, which includes the auxiliary cam and weight section integrally formed therewith, comprises a single piece supported for rotation upon the first collar. In this manner, the present compression release mechanism includes only one moving part, and is therefore simplified in operation and in construction. Further, forces resulting from the contact between the auxiliary cam and the valve are transferred directly through the second collar and the first collar to the camshaft itself, increasing the operational life and durability of the compression release mechanism.

In one form thereof the present invention provides an internal combustion engine, including a camshaft including a longitudinal axis and at least one cam lobe, the cam lobe including a portion projecting beyond a base circle of the cam lobe for periodically engaging a valve, the camshaft further including an annular bearing surface disposed in eccentric relation with respect to the camshaft longitudinal axis; and a compression release mechanism, including a compression release member including an auxiliary cam, the compression release member supported for rotation on the annular bearing surface between a first position corresponding to engine cranking speeds in which the auxiliary cam is positioned outside of the cam lobe base circle to engage and at least partially open the valve, and a second position corresponding to engine running speeds in which the auxiliary cam is positioned within the cam lobe base circle and does not engage the valve.

In another form thereof, the present invention provides an internal combustion engine, including a camshaft having at least one cam lobe, the cam lobe including a portion projecting beyond a base circle of the cam lobe for periodically engaging a valve; and a compression release mechanism, including a first collar rotationally fixed with respect to the camshaft, the first collar having a hub portion eccentric to the camshaft; a second collar including an auxiliary cam, the second collar supported for rotation on the hub portion of the first collar between a first position corresponding to an engine cranking speed, in which the auxiliary cam is positioned outside of the cam lobe base circle to engage and at least partially open the valve, and a second position corresponding to an engine running speed, in which the auxiliary cam is positioned within the cam lobe base circle and does not engage the valve.

In a further form thereof, the present invention provides an internal combustion engine, including a camshaft having a longitudinal axis and at least one cam lobe, the cam lobe including a portion which projects beyond a base circle of the cam lobe for periodically engaging a valve, the camshaft further including an annular bearing surface having a central axis offset from the longitudinal axis; and a compression release mechanism, including a collar supported for rotation on the bearing surface, the collar including an auxiliary cam, and a weight section disposed around a portion of a circumference of the collar; a spring connecting the camshaft and the collar and biasing the collar to a first position in which the auxiliary cam is positioned outside of the cam lobe base circle to engage and at least partially open the valve, whereby at engine running speeds, the inertia of the weight section overcomes the bias of the spring, causing the collar to rotate to a second position in which the auxiliary cam is positioned within the cam lobe base circle and does not engage the valve.

In a further form thereof, the present invention provides an internal combustion engine, including a camshaft having a longitudinal axis and at least one cam lobe, the cam lobe including a portion projecting beyond a base circle of the cam lobe for periodically engaging a valve; and a compression release mechanism, including an annular bearing surface having a central axis offset from the longitudinal axis of the camshaft; and means, rotatably supported on the bearing surface, for engaging the valve at engine cranking speeds and not engaging the valve at engine running speeds.

BRIEF DESCRIPTION OF THE DRAWINGS

The above-mentioned and other features and advantages of this invention, and the manner of attaining them, will become more apparent and the invention itself will be better understood by reference to the following description of embodiments of the invention taken in conjunction with the accompanying drawings, wherein.

Corresponding reference characters indicate corresponding parts throughout the several views. The exemplifications set out herein illustrate preferred embodiments of the invention, and such exemplifications are not to be construed as limiting the scope of the invention any manner.

DETAILED DESCRIPTION

Figure 1:
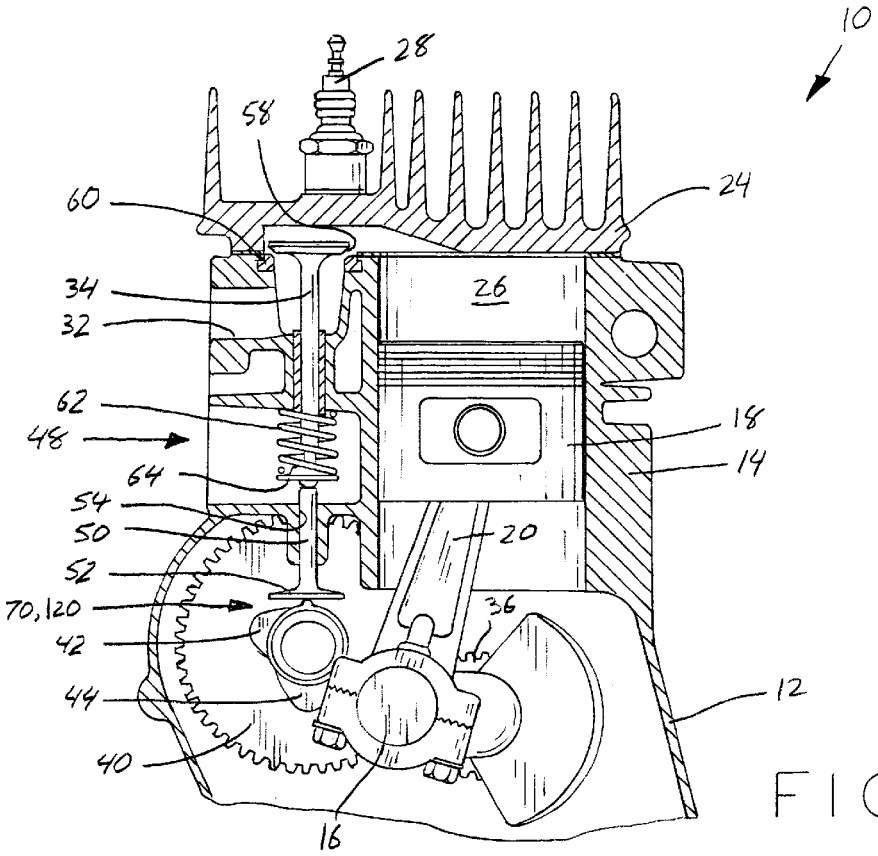
FIG. 1 is an elevational view of an exemplary engine, including a camshaft having a compression release mechanism in accordance with the present invention.

Referring to FIG. 1, there is shown a single cylinder, 4-stroke internal combustion engine 10 including a compression release mechanism 70, 120 according to the present invention. Although FIG. 1 illustrates a single cylinder 4-stroke engine, the present compression release mechanism 70, 120 is not necessarily limited to this particular type of engine. Additionally, although engine 10 in FIG. 1 includes a side valve or "L-head" type of valve train configuration as described hereinafter, the compression release mechanism 70, 120 of the present invention may also be used in overhead valve ("OHV") engines and in overhead cam ("OHC") engines. One exemplary overhead cam engine is disclosed in the above-incorporated U.S. Pat. No. 6,295,959.

Engine 10 includes crankcase 12, cylinder 14, crankshaft 16, and piston 18, with piston 18 being operatively connected to crankshaft 16 through connecting rod 20. Crankshaft 16 may disposed in either a vertical or a horizontal orientation, depending upon the application in which engine 10 is used. Piston 18 cooperates with cylinder 22 and cylinder head 24 to define a combustion chamber 26. Spark plug 28 secured in cylinder head 24 ignites a fuel/air mixture therein after the fuel/air mixture has been brought into combustion chamber 26 during the intake stroke and has been compressed during the compression stroke of piston 18. The spark is normally timed to ignite the fuel/air mixture just before piston 18 completes its assent on the compression stroke. The fuel/air mixture is drawn into combustion chamber 20 from the carburetor of the engine through an intake passage (not shown) having an intake valve therein, and the products of combustion are expelled from combustion chamber 20 during the exhaust stroke through exhaust port 32 controlled by exhaust valve 34. Exhaust valve 34 additionally functions as a compression release valve in a manner to be discussed hereinafter; however, the intake valve of the engine may also function as a compression release valve using the compression release mechanism 70, 120 of the present invention.

Engine 10 further includes drive gear 36 mounted on crankshaft 16 for rotation therewith, and camshaft gear 40 mounted on camshaft 38 and rotatably driven by drive gear 36 to thereby rotate camshaft 38 at one-half crankshaft speed. Camshaft 38 includes conventional pear-shaped intake and exhaust camshaft lobes 42 and 44, respectively, which rotate with camshaft 38 to impart reciprocating motion to the intake valve and to exhaust valve 34 via tappets 50. In the embodiment shown in the drawings, intake lobe 42 is the inboard lobe adjacent camshaft gear 40, and exhaust lobe. 44 is outboard of camshaft gear 40 and intake lobe 42.

Exhaust valve train 48 is shown in FIG. 1, and includes tappet 50 which has a circular follower 52 with a flat undersurface adapted to bear tangentially against and track upon the periphery of exhaust lobe 44. Tappet 50 slides in guide boss 54 of crankcase 12, and its upper end pushes against the tip of exhaust valve 34. In operation, tappet 50 lifts the stem of exhaust valve 34, which lifts face 58 of exhaust valve 34 from valve seat 60. Valve spring 62 encircles stem 56 between valve guide 54 and spring retainer 64. Spring 62 biases exhaust valve 34 closed and also biases tappet 50 into tracking contact with exhaust lobe 44.

To aid in starting engine 10, mechanical compression release mechanism 70, 120 is provided according to first and second embodiments which will be described hereinafter. When compression release mechanism 70, 120 is in an inoperative position, corresponding to engine running speeds, the rotation of exhaust lobe 44 of camshaft 38 causes normal operation of exhaust valve 34, so that exhaust valve 34 opens and closes in timed and periodic relation with the travel of piston 18 according to conventional timing practice. Thus, exhaust lobe 44 is adapted to open exhaust valve 34 near the end of the power stroke and to hold same open during assent of piston 18 on the exhaust stroke until piston 18 has moved slightly past top dead center. As exhaust lobe 44 continues to rotate, spring 62 forces tappet 50 downwardly and exhaust valve 34 is reseated. Exhaust valve 34 is held in a closed position during the ensuing intake, compression, and power strokes. Intake camshaft lobe 32 is likewise of conventional fixed configuration to control the intake valve such that it completely closes shortly after piston 18 begins its compression stroke and remains closed throughout the subsequent power and exhaust strokes, and reopening to admit the fuel mixture on the intake stroke.

Since in a conventional engine, the intake and exhaust valves are normally closed for the major portion of the compression stroke, cranking of the engine would be difficult unless some provision is made to vent combustion chamber 26 during a part of, or all of, the compression stroke during cranking of engine 10. However, by incorporating the improved compression release mechanism 70, 120 of the present invention, compression relief is automatically obtained at cranking speeds to greatly reduce cranking effort and thereby facilitate starting. Moreover, a conventional engine 10 need not be significantly physically altered to effect compression release with the mechanism 70, 120 of the present invention incorporated therein. The compression release mechanism 70, 120 is responsive to engine speed such that it is automatically rendered inoperative at engine running speeds so that there is no compression loss to decrease the efficiency of engine 10 when it is running under its own power.

Figure 2:
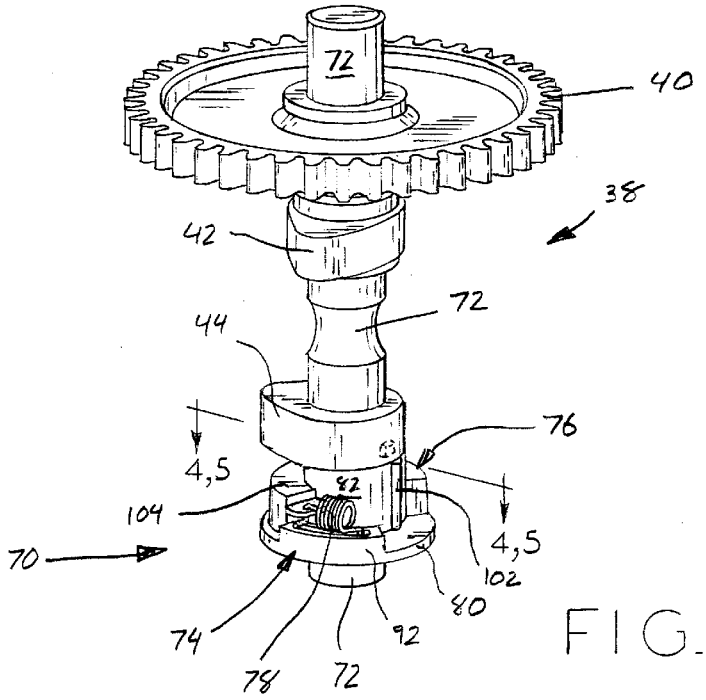
FIG. 2 is a perspective view of the camshaft and the compression release mechanism of the engine of FIG. 1.
Figure 3:
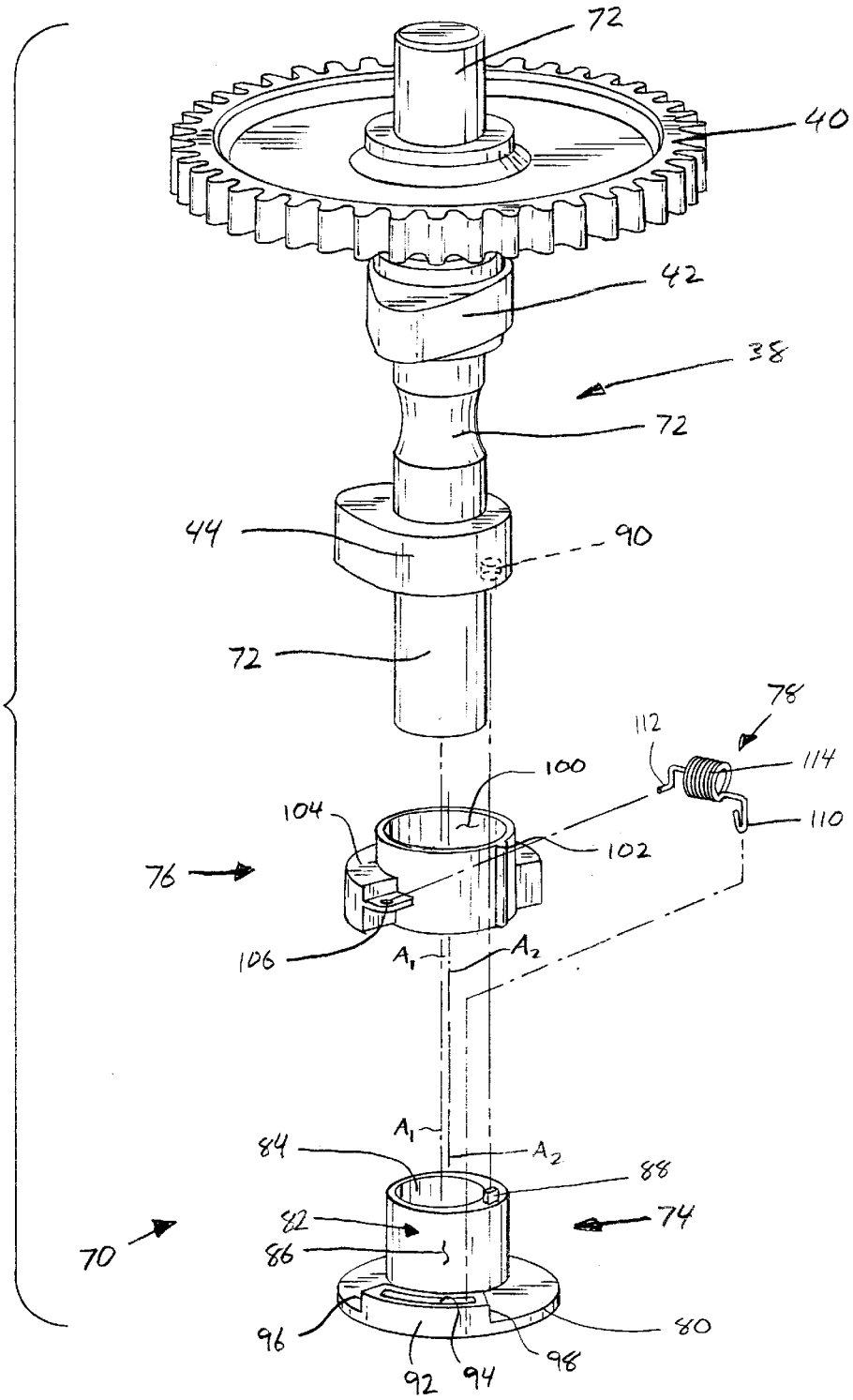
FIG. 3 is an exploded view of the camshaft and compression release mechanism of FIG. 2.

Compression release mechanism 70 according to a first embodiment is shown with reference to FIGS. 2–5. Referring first to FIGS. 2 and 3, camshaft 38 is shown, which may be made from cast iron or steel, for example. Camshaft 38 includes shaft portion 72 having intake lobe 42, exhaust lobe 44, and camshaft gear 40 affixed thereto. Intake and exhaust lobes 42, 44, and camshaft gear 40 may be formed of a suitable rigid plastic material which is molded onto shaft portion 72 of camshaft 38. Intake and exhaust lobes 42, 44 and camshaft gear 40 may be either integrally formed with one another as a unit which is attached to camshaft 38, or alternatively, intake and exhaust lobes 42, 44 and camshaft gear 40 may be formed separately from one another.

Mechanical compression release mechanism 70 is attached to camshaft 38, and generally includes stop collar 74, weight collar 76, and spring 78. Referring to FIG. 3, stop collar 74 may be made from a rigid plastic material, or a suitable metal such as powder metal, aluminum, or steel, for example, and generally includes annular flange 80 and hub annular portion 82. Hub portion 82 includes bore 84 therethrough, as well as outer annular bearing surface 86. Bore 84 is disposed along a longitudinal axis which is co-linear with longitudinal axis $A_1$—$A_1$ of shaft portion 72 of camshaft 38, while annular bearing surface 86 of hub portion 82 has a central axis $A_2$—$A_2$ which is offset from axis $A_1$—$A_1$. In this manner, annular bearing surface 86 of hub portion 82 is eccentric with respect to bore 84 of hub portion 82 and longitudinal axis $A_1$—$A_1$ of shaft portion 72 of camshaft 38.

After weight collar 76, described below, is placed onto hub portion 82 of stop collar 74, stop collar 74 is inserted onto shaft portion 72 of camshaft 38, and anchor projection 88 of hub portion 82 is fitted within recess 90 of exhaust cam lobe 44 to fixedly connect stop collar 74 to exhaust cam lobe 44. Thus, stop collar 74 is rotationally fixed with respect to camshaft 38, and rotates therewith. Alternatively, stop collar 74 could be fixed with respect to camshaft 38 by welding stop collar 74 directly to shaft portion 72 or to exhaust cam lobe 44 of camshaft 38, for example. Stop collar 74 additionally includes stop segment 92 integrally formed therewith, which extends in an arcuate manner around at least a portion of the circumference of annular flange 80 of stop collar 74. Stop segment 92 includes arcuate slot 94 therein, and additionally includes first stop surface 96 and second stop surface 98 at opposite ends thereof.

Although stop collar 74 has been described above as a separate component attached to camshaft 38, other configurations are possible. For example, hub portion 82 of stop collar 74 may be integrally formed with shaft portion 72 of camshaft 38, such that camshaft 38 includes annular outer bearing surface 86 for rotationally supporting weight collar 76. In this configuration, annular flange 80 and stop segment 92 may together comprise a separate component which is fitted onto camshaft 38 in a suitable manner adjacent annular outer bearing surface 86.

Weight collar 76 is an annular member made from a relatively heavy or dense metal, such as steel or cast iron, for example, and includes inner annular bearing surface 100 rotationally slidable upon outer annular bearing surface 86 of stop collar 74 when weight collar 76 is positioned thereon. Weight collar 76 includes auxiliary cam 102 integrally formed therewith, which extends outwardly from the outer periphery of weight collar 76. Further, weight collar 76 includes an arcuately-shaped, integral weight section 104 disposed around at least a portion of the circumference thereof. For example, as shown in FIG. 3, weight section 104 extends approximately 180° around the circumference of weight collar 76. Weight section 104 additionally includes hole 106 therein.

Figure 4:
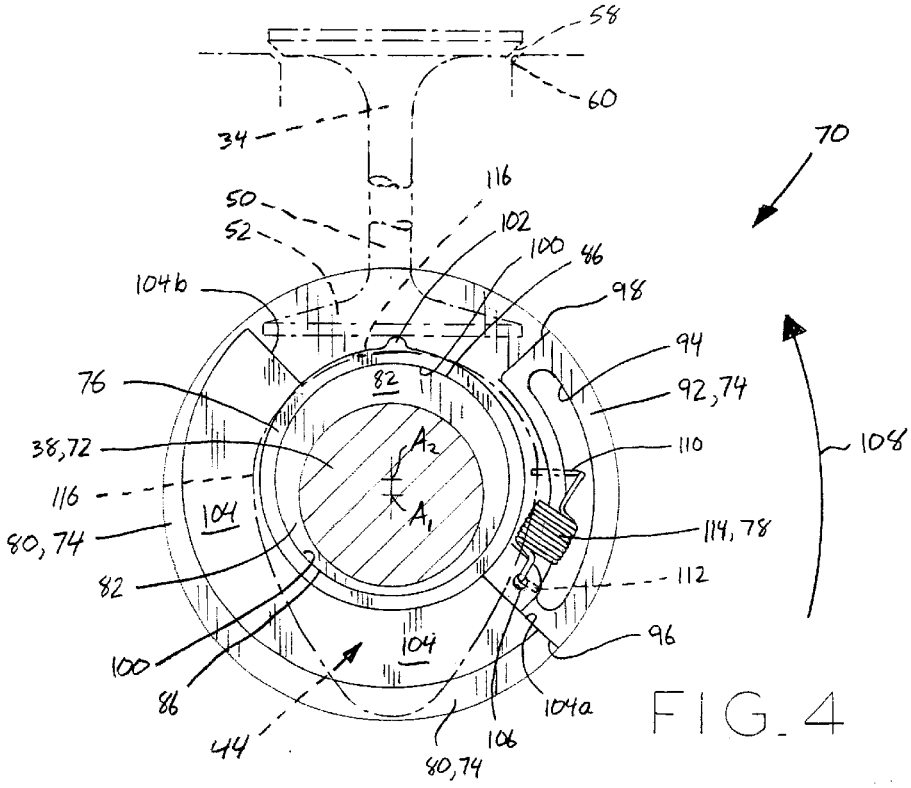
FIG. 4 is a sectional view through the camshaft, taken along line 4—4 of FIG. 2 with the exhaust cam lobe and components of the exhaust valve in phantom, showing the compression release mechanism in a first operational position corresponding to engine cranking speeds.
Figure 5:
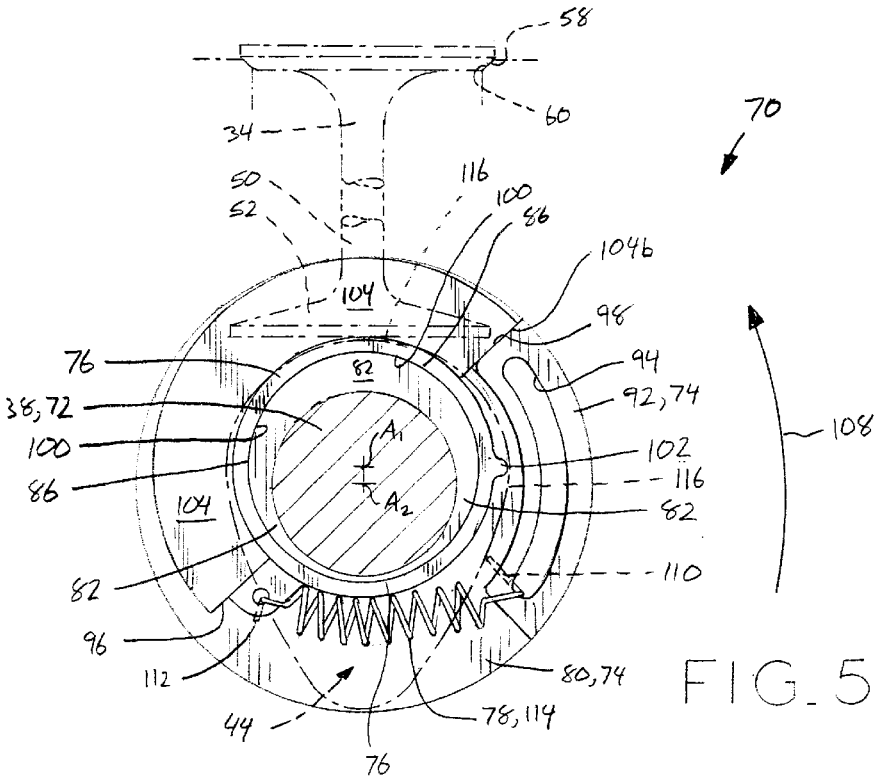
FIG. 5 is a sectional view through the camshaft, taken along line 5—5 of FIG. 2 with the exhaust cam lobe and components of the exhaust valve in phantom, showing the compression release mechanism in a second operational position corresponding to engine running speeds.

Spring 78 connects stop collar 74 and weight collar 76, and includes first end 110, second end 112, and coil portion 114 intermediate first and second ends 110, 112. First end 110 of spring 78 is received through arcuate slot 94 of stop collar 74 and slidably engages the rear surface of annular flange 80 of stop collar 74 which is disposed opposite hub portion 82. Second end 112 of spring 78 is fixedly attached to hole 106 in weight section 104 of weight collar 76. One suitable spring is 9.5 mm in length from first end 110 to second end 112 when no load is imposed thereon, such as when weight collar 76 is in its first operational position corresponding to engine cranking speeds, as shown in FIG. 4 and described below. This spring stretches to 19.0 mm in length under a load of 14±2 grams in the second operational position of weight collar 76 which corresponds to engine running speeds, as shown in FIG. 5 and described below.

The operation of compression release mechanism 70 will be described with primary reference to FIGS. 4 and 5. In FIG. 4, compression release mechanism 70 is shown with weight collar 76 disposed in a first rotational position which corresponds to engine cranking speeds. At engine cranking speeds, camshaft 38 rotates relatively slowly in the direction of arrow 108 in FIG. 4, and weight collar 76 rotates together with stop collar 74 and camshaft 38. Further, spring 78 biases weight collar 76 toward the position shown in FIG. 4 at cranking speeds, in which auxiliary cam 102 of weight collar 76 is disposed proximate the widest or thickest section of hub portion 82 of stop collar 74, such that auxiliary cam 102 projects beyond the base circle 116 of exhaust cam lobe 44. In this manner, auxiliary cam 102 will contact follower 52 of tappet 50 during the compression stroke of engine 10 to partially open or unseat exhaust valve 34 in order to release at least a portion of the pressure within combustion chamber 26 as piston 18 approaches top dead center position to aid in engine cranking. Further, first edge 104*a* of weight section 104 of stop collar 74 is disposed proximate first stop surface 96 of stop segment 92 of stop collar 74.

After engine 10 starts, the rotational speed of camshaft 38 along arrow 108 increases rapidly. However, the inertial load which is inherent from the mass of weight section 104 of weight collar 76 initially resists concurrent rotation of weight collar 76 with stop collar 74 and camshaft 38. Thus, when the speed of camshaft 38 rapidly increases, the rotational speed of weight collar 76 is initially less than the rotational speed of stop collar 74 and camshaft 38. The foregoing rotational speed difference between weight collar 76 and stop collar 74 results in rotation of weight collar 76 upon hub portion 82 of stop collar 74, in which inner annular bearing surface 100 of weight collar 76 rotationally slides with respect to outer annular bearing surface 86 of stop collar 74.

During an initial extent of rotation of weight collar 76 upon hub portion 82 of stop collar 74, first end 110 of spring 78 slides within arcuate slot 94 of stop segment 92 until first end 110 of spring 78 contacts the edge of arcuate slot 94. Due to the need for compression release mechanism 70 to occupy a small spatial area within small engines, the size and thus the mass of weight collar 76 is somewhat limited. Thus, the inertial force of weight collar 76 is correspondingly limited. In this manner, for many applications in which compression release mechanism 70 is used, a type of spring having a load which increases proportionally with increasing spring length as the spring is stretched may not be desirable because, as weight collar 76 rotates and the spring stretches, the spring load could eventually overcome the inertial force of weight collar 76 to thereby inhibit rotation of weight collar 76 upon hub portion of stop collar 74. However, in compression release mechanism 70, first end 110 of spring 78 slides within arcuate slot 94 of stop segment 92 during an initial portion of the rotation of weight collar 76, such that spring 78 does not begin to stretch and to thereby impose a load until a later point in the rotational progression of weight collar 76. In this manner, as described below, the load of the stretched spring 78 will not overcome the inertial load of weight collar 76 at engine running speeds.

As an alternative to the configuration of stop collar 74, weight collar 76, and spring 78 shown in FIGS. 2–6 and described herein, arcuate slot 94 may be removed, and a spring having a spring load which remains constant throughout the stretching of the spring may be connected directly between stop collar 74 and weight collar 76, wherein the constant load of such a spring is selected such that it does not overcome the inertial load of weight collar 76 at engine running speeds.

Referring again to FIGS. 4 and 5, after first end 110 of spring 78 contacts the edge of arcuate slot 94, the inertial load of weight section 104 of weight collar 76 overcomes the spring load of spring 78 as the rotational speed of camshaft 38 increases, and continued rotation of weight collar 76 upon hub portion 82 of stop collar 74 forces coil portion 114 of spring 78 to expand, thereby stretching spring 78 under tension. Weight collar 76 rotates upon hub portion 82 of stop collar 74 until second edge 104*b* of weight section 104 contacts second stop surface 98 of stop segment 92 of stop collar 74, as shown in FIG. 5, and the engagement between weight section 104 and stop segment 92 of stop collar 74 forces weight collar 76 to rotate together with stop collar 74 and camshaft 38. Weight collar 76 remains in this position, shown in FIG. 5, at engine running speeds with spring 78 stretched under tension. Weight collar 76 rotates approximately 90° between its first operational position shown in FIG. 4 and its second operational position shown in FIG. 5.

Referring to FIGS. 4 and 5, during rotation of weight collar 76 upon hub portion 82 of stop collar 74, auxiliary cam 102 of weight collar 76 rides around the outer annular bearing surface of hub portion 82, which is eccentric to shaft portion 72 of camshaft 38. In particular, auxiliary cam 102 moves from a first position shown in FIG. 4 in which auxiliary cam 102 is disposed proximate the widest or thickest section of hub portion 82, to a second position shown in FIG. 5 in which auxiliary cam 102 is disposed proximate a more narrow or thin section of hub portion 82. In this manner, as auxiliary cam 102 rotates with weight collar 76 around the eccentric hub portion 82 of stop collar 74, auxiliary cam 102 is progressively retracted within base circle 116 of exhaust cam lobe 44. In the position of FIG. 5 corresponding to engine running speeds, auxiliary cam 102 is disposed completely within base circle 116 of exhaust cam lobe 44, such that auxiliary cam 102 no longer contacts follower 52 of tappet 50, such that exhaust valve 34 may fully close or seat as piston 18 approaches its top dead center position to allow combustion within engine 10 to proceed in a conventional manner.

Upon shutdown of engine 10, the rotational speed of camshaft 38 decreases rapidly. However, the rotational speed of weight collar 76 decreases less rapidly due to the inertial load of weight section 104 of weight collar 76, which urges weight collar 76 to continue to rotate at engine running speed. The difference in the decrease of rotational speed between stop collar 74 (and camshaft 38) and weight collar 76 causes "over-rotation" of weight collar 76, wherein weight collar 76 rotates upon hub portion 82 of stop collar 74 from the position shown in FIG. 5 back to the position shown in FIG. 4. Also, the decrease in rotational speed of weight collar 76 reduces the inertial load of weight section 104, such that a return force exerted by the contraction of coil portion 114 of spring 78 overcomes the inertial load of weight section 104 and allows spring 78 to bias weight collar 76 back to the position shown in FIG. 4.

Advantageously, when compression release mechanism 70 is disposed in the position shown in FIG. 4 at engine cranking speeds, contact forces between follower 52 of tappet 50 and auxiliary cam 102 are transmitted directly through weight collar 76 and stop collar 74 to camshaft 38 itself, and therefore are not distributed to other parts of the compression release mechanism 70, such as weight section 104 and spring 78. In addition, compression release mechanism 70 includes only one moving part, namely, weight collar 76. For the foregoing reasons, compression release mechanism 70 is less prone to fatigue or failure, increasing the operational life of compression release mechanism 70.

Further, referring to FIG. 2, it can be seen that weight collar 76, which is rotationally supported upon hub portion 82 of stop collar 74, has a relatively thin profile and is disposed directly adjacent exhaust cam lobe 44, such that the width of compression release mechanism 70 between exhaust cam lobe 44 and annular flange 80 of stop collar 74 is minimized, and space within engine 10 is conserved.

Figure 6:
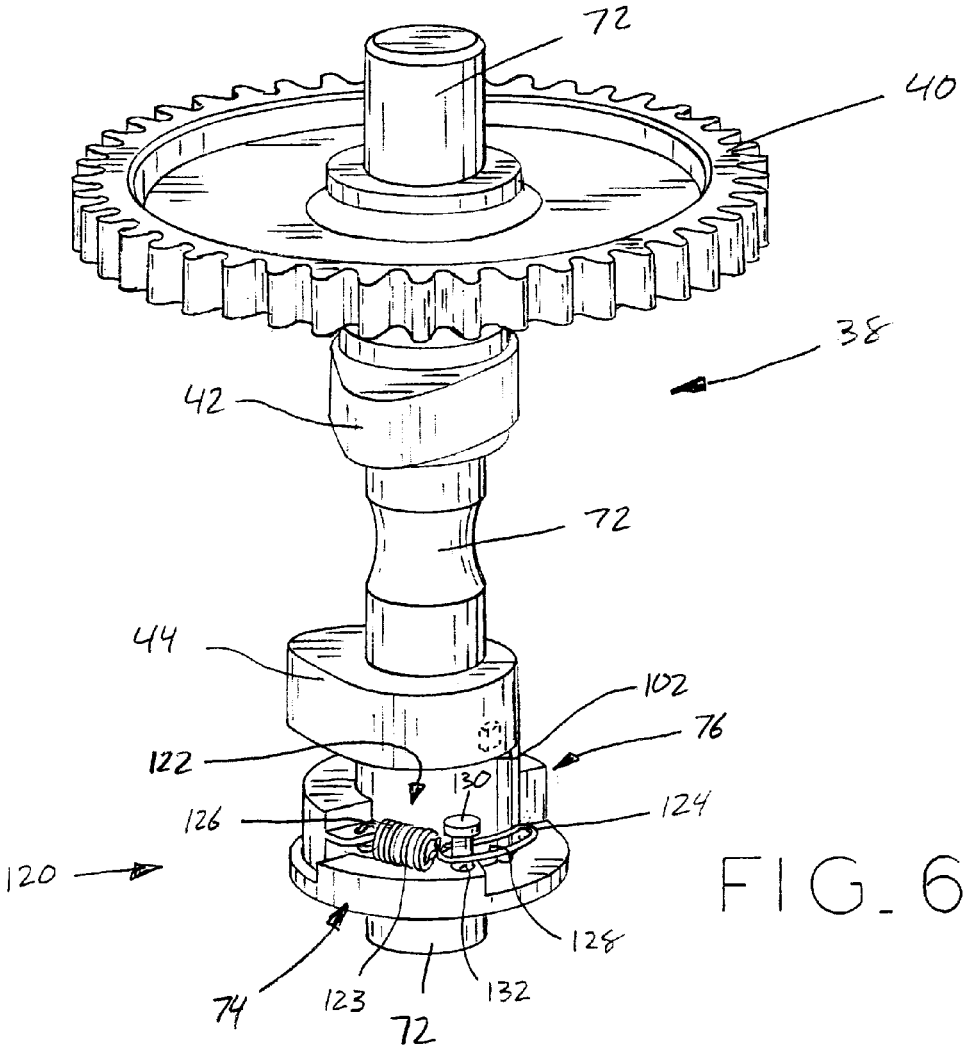
FIG. 6 is a perspective view of a compression release mechanism according to a second embodiment.
Figure 1:
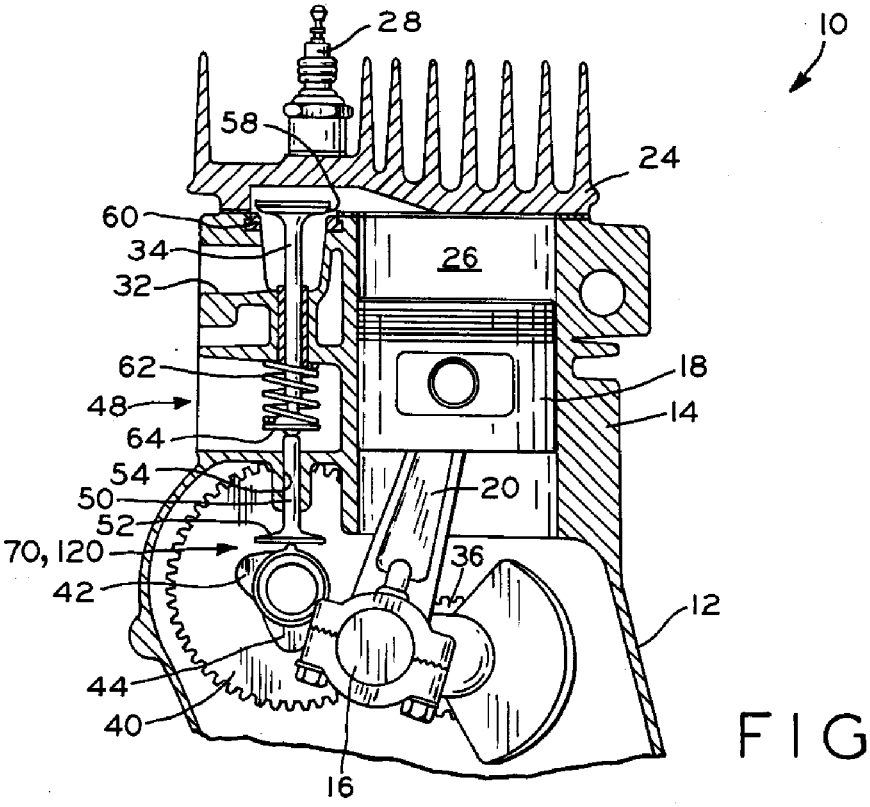
Figure 2:
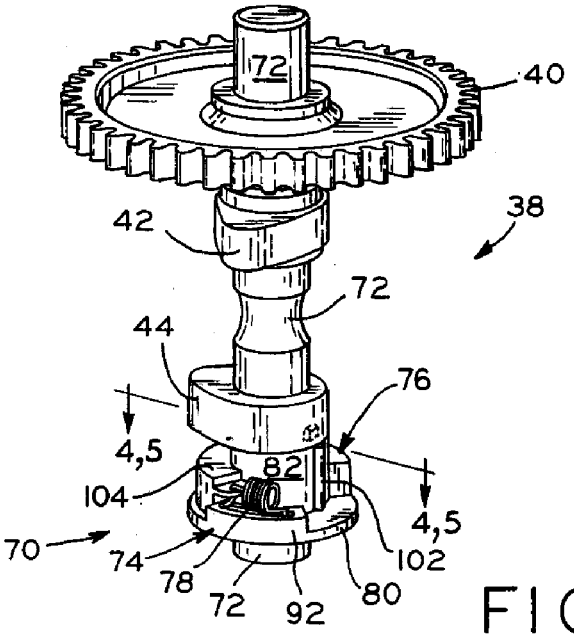
Figure 3:
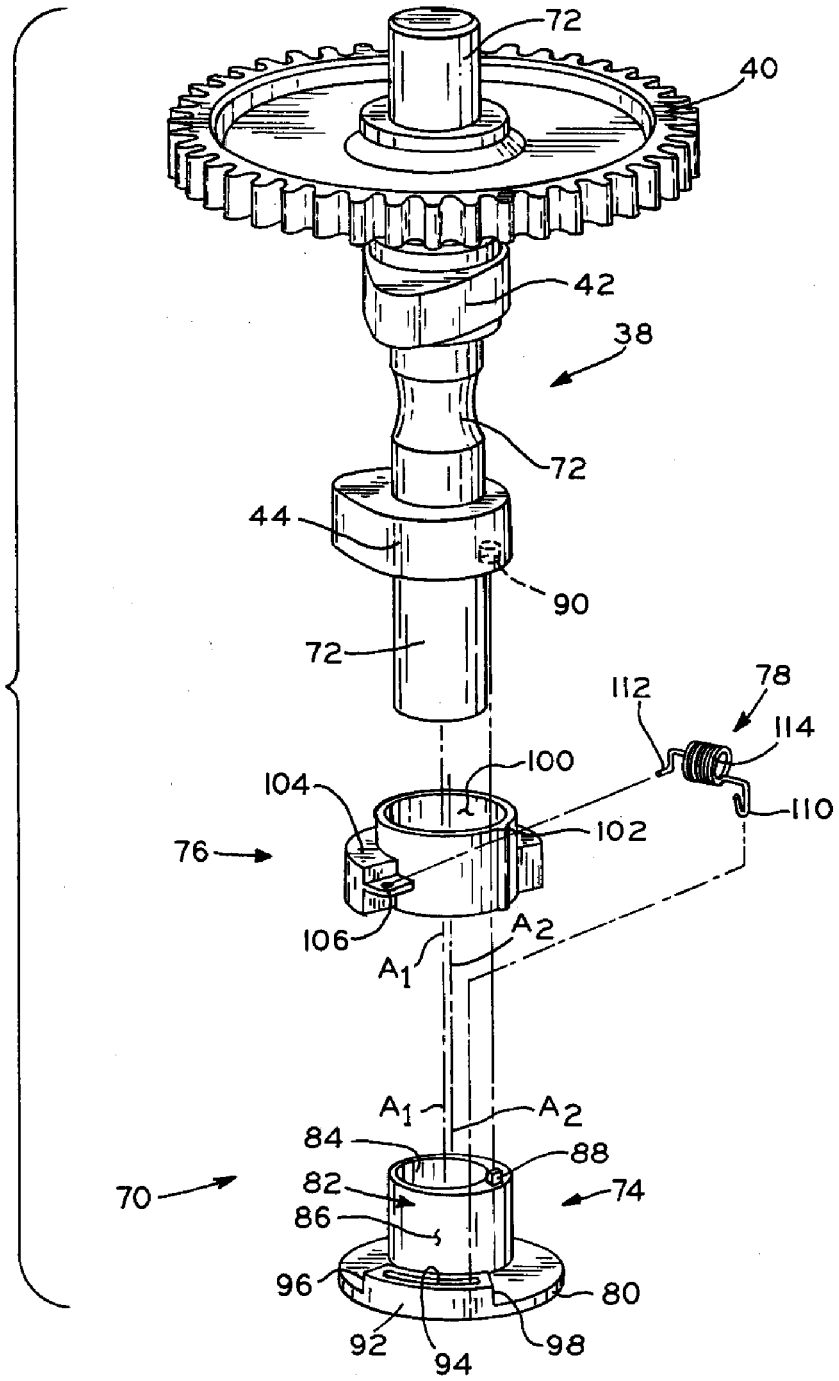
Figure 4:
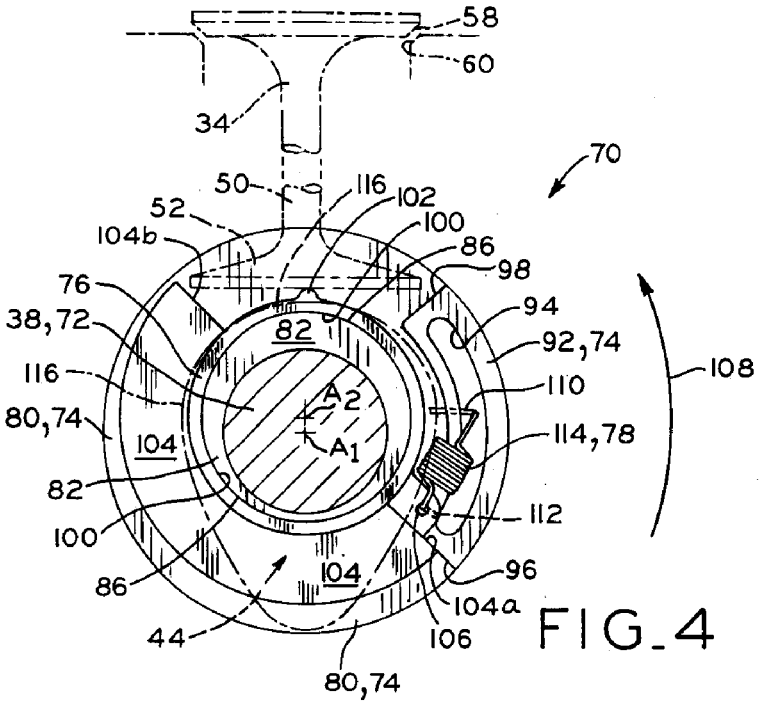
Figure 5:
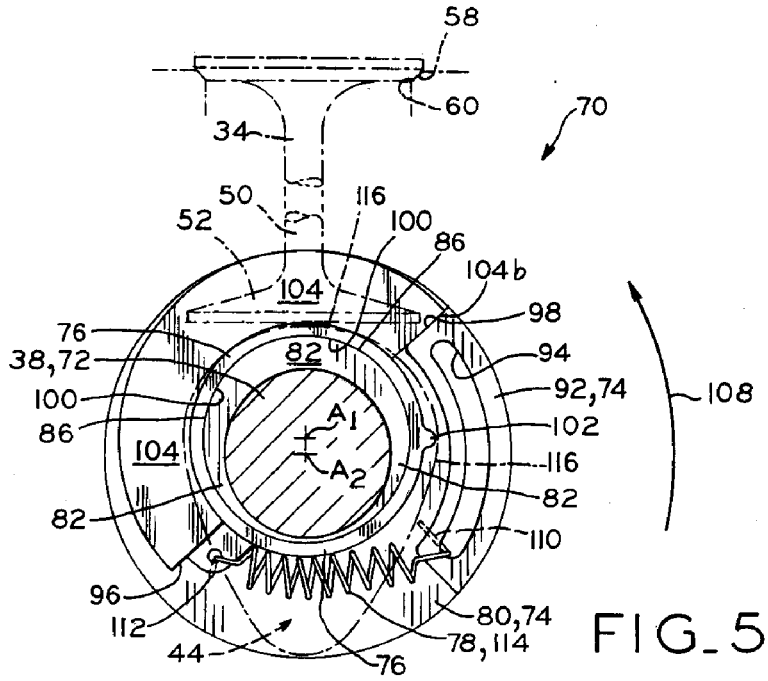
Figure 6:
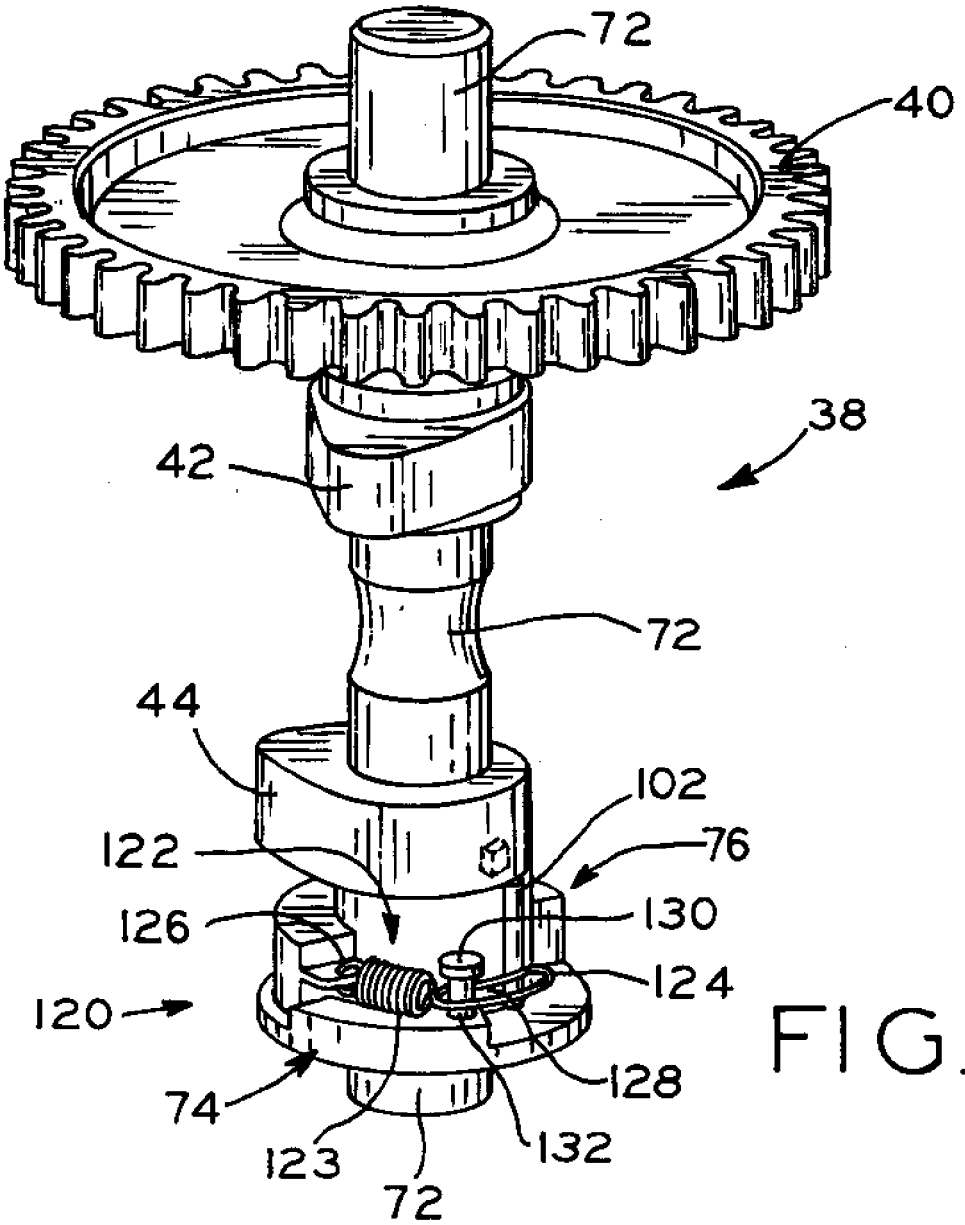

Referring to FIG. 6, compression release mechanism 120 according to a second embodiment is shown, including stop collar 74 and weight collar 76, which are each substantially similar to those described above with respect to compression release mechanism 70. In the embodiment of FIG. 6 however, spring 122 includes coil portion 123, first end 124 defining slot portion 128 therein, and second end 126 connected to weight section 102 of weight collar 76. Pin 130 is received through slot portion 128 of spring 122, and is fitted within an aperture 132 in stop collar 74.

The operation of compression release mechanism 120 is identical to that of compression release mechanism 70 according to the first embodiment as described above, except that, during initial rotation of weight collar 76 upon hub portion 82 of stop collar 74 after engine 10 is started and the speed of rotation of camshaft 38 rapidly increases, slot portion 128 of spring 122 guidingly slides around pin 130 until pin 130 contacts the end of slot portion 128. Thereafter, further rotation of weight collar 76 causes spring 122 to be placed under tension. Upon engine shutdown, spring 122 returns weight collar 76 to its initial position, shown in FIG. 6.

While this invention has been described as having a preferred design, the present invention can be further modified within the spirit and scope of this disclosure. This application is therefore intended to cover any variations, uses, or adaptations of the invention using its general principles. Further, this application is intended to cover such departures from the present disclosure as come within known or customary practice in the art to which this invention pertains and which fall within the limits of the appended claims.

What is claimed is:

1. An internal combustion engine, comprising:

a camshaft including a longitudinal axis and at least one cam lobe, said cam lobe including a portion projecting beyond a base circle of said cam lobe for periodically engaging a valve, said camshaft further including an outer annular bearing surface disposed in eccentric relation with respect to said camshaft longitudinal axis, and a compression release mechanism, comprising:

a compression release member including an auxiliary cam and an inner annular bearing surface rotatably supported on said outer annular bearing surface between a first position corresponding to engine cranking speeds in which said auxiliary cam is positioned outside of said cam lobe base circle to engage and at least partially open said valve, and a second position corresponding to engine running speeds in which said auxiliary cam is positioned within said cam lobe base circle and does not engage said valve.

2. The internal combustion engine of claim 1, further comprising a spring connected between said camshaft and said compression release member, said spring biasing said compression release member to said first position.

3. An internal combustion engine, comprising:

a camshaft including a longitudinal axis and at least one cam lobe, said cam lobe including a portion projecting beyond a base circle of said cam lobe for periodically engaging a valve, said camshaft further including an annular bearing surface disposed in eccentric relation with respect to said camshaft longitudinal axis; and a compression release mechanism, comprising:

an annular compression release member including an auxiliary cam and a weight section disposed around a portion of a circumference thereof, said compression release member supported for rotation on said annular bearing surface between a first position corresponding to engine cranking speeds in which said auxiliary cam is positioned outside of said cam lobe base circle to engage and at least partially open said valve, and a second position corresponding to engine running speeds in which said auxiliary cam is positioned within said cam lobe base circle and does not engage said valve.

4. The internal combustion engine of claim 3, further comprising a pair of stop surfaces cooperating with said annular bearing surface, said stop surfaces engageable with said weight section of said compression release member to define rotational limits of said compression release member between said first and second positions.

5. The internal combustion engine of claim 4, wherein said annular bearing surface and said stop surfaces are formed together as a collar member, said collar member fixed for rotation with said camshaft.

6. An internal combustion engine, comprising:

a camshaft having at least one cam lobe, said cam lobe including a portion projecting beyond a base circle of said cam lobe for periodically engaging a valve; and a compression release mechanism, comprising:

a first collar rotationally fixed with respect to said camshaft, said first collar having a hub portion eccentric to said camshaft;

a second collar including an auxiliary cam, said second collar supported for rotation on said hub portion of said first collar between a first position corresponding to an engine cranking speed, in which said auxiliary cam is positioned outside of said cam lobe base circle to engage and at least partially open said valve, and a second position corresponding to an engine running speed, in which said auxiliary cam is positioned within said cam lobe base circle and does not engage said valve.

7. The internal combustion engine of claim 6, wherein said camshaft includes a longitudinal axis, and said hub portion of said first collar includes a central axis which is offset from said longitudinal axis.

8. The internal combustion engine of claim 6, wherein said hub portion of said first collar defines an outer annular bearing surface, and said second collar defines an inner annular bearing surface rotatably supported on said outer annular bearing surface.

9. The internal combustion engine of claim 6, wherein said first collar and said cam lobe are fixedly connected to one another.

10. The internal combustion engine of claim 6, wherein said second collar is annular in shape, and includes a weight section disposed around a portion of a circumference of said second collar.

11. The internal combustion engine of claim 10, wherein said first collar includes a pair of stop surfaces engageable with said weight section of said second collar to define rotational limits of said second collar between said first and second positions.

12. The internal combustion engine of claim 6, further comprising a spring connected between said first collar and said second collar, said spring biasing said second collar to said first position.

13. An internal combustion engine, comprising:

a camshaft having a longitudinal axis and at least one cam lobe, said cam lobe including a portion which projects beyond a base circle of said cam lobe for periodically engaging a valve, said camshaft further including an annular bearing surface having a central axis offset from said longitudinal axis; and a compression release mechanism, comprising:

a collar supported for rotation on said bearing surface, said collar including an auxiliary cam, and a weight section disposed around a portion of a circumference of said collar;

a spring connecting said camshaft and said collar and biasing said collar to a first position in which said auxiliary cam is positioned outside of said cam lobe base circle to engage and at least partially open said valve, whereby at engine running speeds, the inertia of said weight section overcomes the bias of said spring, causing said collar to rotate to a second position in which said auxiliary cam is positioned within said cam lobe base circle and does not engage said valve.

14. The internal combustion engine of claim 13, wherein said collar includes a pair of radially spaced stop surfaces cooperating with said annular bearing surface thereof.

15. The internal combustion engine of claim 14, wherein in said first position, said weight section of said collar is disposed adjacent one of said stop surfaces, and in said second position, said weight section engages the other of said stop surfaces.

16. The internal combustion engine of claim 13, wherein said annular bearing surface and said stop surfaces are formed together as a collar member, said collar member fixed for rotation with said camshaft.

17. An internal combustion engine, comprising:

a camshaft having a longitudinal axis and at least one cam lobe, said cam lobe including a portion projecting beyond a base circle of said cam lobe for periodically engaging a valve; and a compression release mechanism, comprising:

an annular outer bearing surface having a central axis offset from said longitudinal axis of said camshaft; and means, rotatably supported on said bearing surface, for engaging said valve at engine cranking speeds and not engaging said valve at engine running speeds.

18. The internal combustion engine of claim 17, wherein said engaging means comprises a weight section, said weight section inertially positioning said engaging means responsive to engine speed.

19. The internal combustion engine of claim 17, further comprising means for positioning said engaging means at engine cranking speeds such that said engaging means engages said valve.

* * * * *

UNITED STATES PATENT AND TRADEMARK OFFICE

CERTIFICATE OF CORRECTION

PATENT NO. : 6,792,905 B2
DATED : September 21, 2004
INVENTOR(S) : Giuseppe Ghelfi et al.

It is certified that error appears in the above-identified patent and that said Letters Patent is hereby corrected as shown below:

The title page should be deleted to appear as per attached title page.

The sheets of drawings consisting of figures 1-6 should be deleted to appear as per attached Figures 1-6.

Signed and Sealed this

Eighteenth Day of January, 2005

JON W. DUDAS
*Director of the United States Patent and Trademark Office*

(12) United States Patent
Ghelfi et al.

(10) Patent No.: US 6,792,905 B2
(45) Date of Patent: Sep. 21, 2004

(54) COMPRESSION RELEASE MECHANISM

(75) Inventors: Giuseppe Ghelfi, Turin (IT); Maurizio Borio, Turin (IT); Stefano Albanello, Chatillon (IT); Giovanni Arisio, Turin (IT)

(73) Assignee: Tecumseh Products Company, Tecumseh, MI (US)

( * ) Notice: Subject to any disclaimer, the term of this patent is extended or adjusted under 35 U.S.C. 154(b) by 0 days.

(21) Appl. No.: 10/351,202

(22) Filed: Jan. 24, 2003

(65) Prior Publication Data

US 2004/0144352 A1 Jul. 29, 2004

(51) Int. Cl.[7] ..... F01L 13/08
(52) U.S. Cl. ..... 123/182.1
(58) Field of Search ..... 123/182.1

(56) References Cited

U.S. PATENT DOCUMENTS

| | | | | |
|---|---|---|---|---|
| 754,466 A | | 3/1904 | Lewis | 123/182.1 |
| 862,448 A | | 8/1907 | Cornilleau | 123/90.17 |
| 4,696,266 A | * | 9/1987 | Harada | 123/182.1 |
| 5,184,586 A | | 2/1993 | Buchholz | 123/182.1 |
| 5,957,097 A | | 9/1999 | Schanz | 123/90.17 |
| 6,109,230 A | * | 8/2000 | Watanabe et al. | 123/182.1 |

FOREIGN PATENT DOCUMENTS

| | | |
|---|---|---|
| DE | 42 21 394 | 1/1994 |

* cited by examiner

*Primary Examiner*—Andrew M. Dolinar
(74) *Attorney, Agent, or Firm*—Baker & Daniels

(57) ABSTRACT

A compression release mechanism for small internal combustion engines, including a compression release member having an auxiliary cam and a weight section. The compression release member is supported for rotation on an annular bearing surface which is in eccentric relation to the longitudinal axis of the engine camshaft. At engine cranking speeds, the compression release member rotates with the camshaft, and the auxiliary cam projects beyond the base circle of a cam lobe on the camshaft to periodically engage a valve to vent pressure from the engine combustion chamber during the compression stroke of the piston to aid in engine cranking. After the engine starts, rapid rotation of the camshaft causes the compression release member to rotate under the inertial load of the weight section thereof to a position in which the auxiliary cam is retracted within the base circle of the cam lobe such that combustion may proceed in a conventional manner.

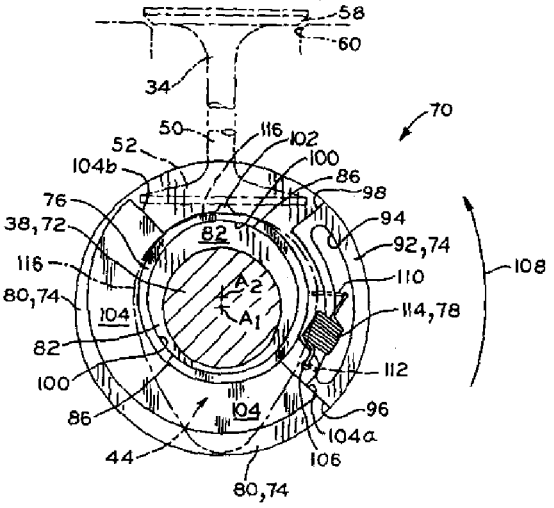

19 Claims, 4 Drawing Sheets